US009500204B2

(12) United States Patent
Hansen et al.

(10) Patent No.: US 9,500,204 B2
(45) Date of Patent: Nov. 22, 2016

(54) WASTE WATER PUMP

(71) Applicant: Grundfos Holding a/s, Bjerringbro (DK)

(72) Inventors: Benny Fredslund Hansen, Randers NV (DK); Poul Johannes Henning, Tjele (DK)

(73) Assignee: Grundfos Holding a/s, Bjerringbro (DK)

( * ) Notice: Subject to any disclaimer, the term of this patent is extended or adjusted under 35 U.S.C. 154(b) by 751 days.

(21) Appl. No.: 13/886,479

(22) Filed: May 3, 2013

(65) Prior Publication Data

US 2013/0294910 A1 Nov. 7, 2013

(30) Foreign Application Priority Data

May 4, 2012 (EP) ..... 12166789

(51) Int. Cl.
*F04D 29/10* (2006.01)
*F04D 29/16* (2006.01)
*F04D 7/04* (2006.01)

(52) U.S. Cl.
CPC ..... *F04D 29/106* (2013.01); *F04D 7/045* (2013.01); *F04D 29/167* (2013.01)

(58) Field of Classification Search
CPC .. F04D 29/007; F04D 29/106; F04D 29/126; F04D 29/167; F04D 29/4213; F04D 29/4293; F04D 29/2255; F04D 29/2288; F04D 7/045; F05D 2250/51
See application file for complete search history.

(56) References Cited

U.S. PATENT DOCUMENTS 2,644,403 A * 7/1953 Dawson ..... F04D 29/167 415/121.1
4,472,109 A 9/1984 Blum
6,234,748 B1 * 5/2001 Brown ..... F04D 29/041 415/170.1

FOREIGN PATENT DOCUMENTS

DE 199 60 160 A1 6/2001
EP 1300594 B1 10/2009
GB 2310252 A 8/1997
WO 2011/079892 A1 7/2011

OTHER PUBLICATIONS

European Search Report issued Oct. 8, 2012 in EP Application No. 12166789.

* cited by examiner

*Primary Examiner* — Christopher Verdier
*Assistant Examiner* — Brian P Wolcott
(74) *Attorney, Agent, or Firm* — Panitch Schwarze Belisario & Nadel LLP

(57) ABSTRACT

A waste water pump includes an impeller (10) having a suction port (12) with a sealing surface (14) which annularly surrounds this and which bears on a stationary seal (18). At least one groove (28) is formed in the sealing surface (14) and to both sides extends beyond a bearing-contact region of the stationary seal (18) on the sealing surface (14). The stationary seal (18) having a first end (30) in connection with an impeller side chamber (20) and an opposite second end (32) is in connection with the suction side of the impeller (10). The pump also includes means (34) for producing turbulences arranged in the impeller side chamber (20) adjacent the seal (18).

15 Claims, 7 Drawing Sheets

WASTE WATER PUMP

BACKGROUND OF THE INVENTION

The present invention relates generally to a waste water pump with an impeller.

Waste water pumps, which can be designed as submersible pumps, serve for pumping away sewage water and waste water. Such waste water often contains solid matter. Conventional pumps, as a rule, are provided with a single-channel or a multi-channel impeller for delivering the waste water. Such pumps are known, for example, from EP 1 300 594 B1 and WO 2011/079892.

The solid matter contained in the waste waters can lead to a blockage of the impeller. In particular, it is problematic that the solid matter can collect in an impeller side chamber on the outer side of the impeller and then can lead to a blockage of the impeller.

A pump is known from GB 2 310 252, with which a thread is formed in the sealing gap at the suction port of the impeller, by way of which thread contamination is to be moved out of the gap. However, a settling of contamination in the impeller side chamber can no longer be securely prevented even with this design, since too large a pressure difference exists between the pressure side and suction side.

BRIEF SUMMARY OF THE INVENTION

It is therefore an objective of a preferred embodiment of the present invention to provide an improved waste water pump, with which the danger of a blockage of the impeller by way of contamination is further reduced.

The above objective is achieved by a waste water pump with the features shown and described herein. Preferred embodiments are to be deduced from the subsequent description as well as the attached figures.

The waste water pump according to a preferred embodiment of the present invention includes at least one impeller, and preferably only one impeller. The impeller in the known manner is driven in rotation via a drive motor. Thereby, the drive motor, preferably an electric motor, can be integrated with the waste water pump into a pump assembly, in particular in the form of a submersible pump assembly. The impeller includes a central suction port, through which the water to be delivered is sucked. Thereby, the waste water pump according to a preferred embodiment of the present invention is not necessarily limited to the delivery of water in the actual sense. The waste water pump according to a preferred embodiment of the present invention can also be used for delivering other fluids.

The suction port is surrounded by an annular sealing surface. Thereby, the sealing surface is preferably essentially cylindrical or conical. The sealing surface sealingly bears on a stationary seal which is held in a surrounding pump housing or spiral housing.

According to a preferred embodiment of the present invention, at least one groove which extends over the bearing-contact region of the seal on the sealing surface is formed in the sealing surface. Thereby, the groove preferably with its two opposed longitudinal ends extends beyond the bearing-contact region of the seal. The groove with a first end, i.e., longitudinal end, is connected to the impeller side chamber, and with a second opposite end or longitudinal end is connected to the suction side of the impeller. The impeller side chamber is that region in the inside of the pump housing or spiral housing, which surrounds the impeller in the region of the side of the seal or sealing surface, said side being away from the suction port. The impeller side chamber thus lies between the suction side and the pressure side of the impeller in its peripheral region and thus forms an intermediate chamber, in which usually a lower pressure prevails than in the pressure chamber of the spiral housing, i.e., in the exit region of the impeller, and a higher pressure than at the suction side of the impeller. It is in this chamber that there is a particular danger of solid matter or contamination being able to collect and then leading to a blockage of the impeller. By way of the at least one groove which connects this impeller side chamber to the suction side of the impeller through the sealing gap between the sealing surface and seal, it is possible for such solid matter or contamination to be led through the groove again to the suction side of the impeller and thus to be removed from the impeller side chamber.

It is preferable for one or more grooves designed in the same manner to be present in the sealing surface. Thereby, the grooves are designed independently of one another, i.e., they are not connected to one another and each groove has an end which is open to the impeller side chamber, and an opposite end which is open to the suction side of the impeller. Two such grooves can for example be formed in the sealing surface. The sealing surface can be formed on the impeller itself or on a component which is connected the impeller. Thus the sealing surface can for example be situated on a wear ring which is connected to the impeller in particular is exchangeably connected to the impeller.

According to a preferred embodiment of the present invention, moreover means for producing turbulences are arranged in the impeller side chamber adjacent the seal. The effect of these means for producing turbulences is that the fluid or the water in the impeller side chamber with the contamination or solid matter contained therein is kept in movement, i.e., swirled. One succeeds in the solid matter or contamination not collecting or agglomerating, but rather individually or in small amounts being able to enter the described grooves together with the fluid, in order to be led again to the suction side of the impeller by way of the pressure difference between the impeller side chamber and the suction side. The means for producing turbulences thus improve the discharge of solid matter out of the impeller side chamber and in particular prevent their accumulation or settling, which would no longer permit a discharge or passage through the described grooves. This is important since the grooves cannot be designed infinitely large, in order not to excessively compromise the sealing characteristics between the seal and the sealing surface. Preferably, the grooves have a width between 1 and 8 mm, preferably between 2 and 5 mm and a depth between 0.5 and 3 mm further preferably between 1 and 2 mm.

Different means can be applied for producing turbulences in the impeller side chamber. In particular, projections and/or recesses can be formed in the walls of the pump housing which are adjacent the impeller side chamber. Alternatively or additionally, projections and/or recesses can also be present in the outer surface of the impeller which is adjacent the impeller side chamber.

The means for producing turbulences are preferably formed on the seal. This permits a particularly favourable manufacture since no additional components are necessary, it is only the seal which needs to be designed accordingly and the means for producing turbulences in the impeller side chamber are introduced on inserting the seal into a surrounding pump housing or spiral housing The means for producing turbulences and which are formed on the seal can be designed as projections and/or recesses. The means for producing turbulences can be formed exclusively on the seal. Alternatively, it is also possible for such means for producing turbulences to cooperate with further means for producing turbulences, on a wall of the pump housing or of the impeller, said wall facing the impeller side chamber.

Particularly preferably, the seal is provided with a structured or wave-like surface on a side which faces the impeller side chamber. Turbulences are produced in the impeller side chamber by the structure or wave shape of the surface. The structure can for example be designed in the form of prominences or recesses on the surfaces of the seal. The impeller side chamber is delimited at one side by the outer side of the impeller. A movement in the peripheral direction is likewise produced in the fluid in the impeller side chamber by the rotation of the impeller. If the fluid then flows over the structured or wave-like surface of the seal, thus turbulences are produced in the impeller side chamber which lead to a swirling or distribution of solid matter and contamination and prevent a collection or agglomeration of this solid matter and contamination. The structure on the surface of the seal can thereby be a shaping which is uniformly or non-uniformly distributed over the periphery or a wave shape, in order to produce the desired turbulences. The height of the waves, i.e., the distance between the wave trough and wave peak, is selected such that the desired turbulences and swirling are achieved. The height of these waves can lie between 0 and 10 mm. Preferably, several wave peaks, for example eight wave peaks are arranged distributed over the periphery. However, other numbers of waves are also conceivable. The wave shape preferably as a whole has rounded or flowing edges, but this however basically also includes an angular wave shape.

According to a further preferred embodiment of the present invention, the waves have their maximal height on the inner periphery of the seal and flatten out to the outer periphery, i.e., the wave peaks and/or the wave troughs extend inclined to the outer periphery, for example, at an angle between 6 and 12°, further preferably between 8 and 10°, to a cross-sectional plane which extends normal to the rotation axis of the impeller.

The sealing gap between the seal and the sealing surface is preferably less than 1 mm, further preferably less than 0.75 mm. The seal is preferably manufactured of an elastomer, for example nitrile rubber. The wave-like surface can be very easily formed in such a material. The complete seal can be manufactured with the structured or wave-like surface for example by way of injection moulding. Thus, the wave-like surface can be very easily formed.

The sealing surface is preferably formed on the outer peripheral surface of the impeller or of the suction port of the impeller and is surrounded by the seal on the outer periphery. The sealing gap between the seal and the sealing surface is thus designed in an essentially cylindrical and, as the case may be, conical manner and extends transversely to a cross-sectional plane intersecting the rotation axis at right angles. The sealing surface and the seal thus preferably lie radially opposite one another, wherein the sealing surface is situated radially inwardly and the seal is situated radially outwardly. For example, the sealing surface is away from the rotation axis, while the surface of the seal which bears on the sealing surface, faces the rotation axis.

The at least one groove in the sealing surface usefully extends in the rotation direction of the impeller. For example, the groove extends inclined to a cross-sectional plane, wherein the cross-sectional plane extends normally to the rotation axis of the impeller. Simultaneously, the groove is inclined such that it does not extend parallel to the rotation axis. Particularly preferably, the groove is inclined at an angle between 5 and 20°, preferably between 6 and 10° with respect to the mentioned cross-sectional plane. Thereby, the groove preferably extends such that the end of the groove which is at the front in the peripheral direction faces the impeller side chamber. Contamination or solid matter moves out of the impeller side chamber through the groove to the suction side of the impeller and into the suction port of the impeller again on account of this inclination of the groove and the pressure difference between the impeller side chamber and the suction side of the impeller.

Particularly preferably, the groove does not extend over the complete periphery around the impeller, but merely in a peripheral part region of the sealing surface. In this manner, a relatively short path from the impeller side chamber to the suction side of the impeller through the groove is created, which favours the transport of solid matter to the suction side of the impeller. Furthermore, the groove can thus be designed larger.

According to a further preferred embodiment of the present invention, means for fragmenting solid matter, in particular fibres are moreover provided. These means are preferably arranged and designed in an annular gap which connects the impeller side chamber to a spiral chamber or pressure chamber surrounding the impeller. By way of this, one succeeds in solid matter or fibres firstly being reduced in size before they enter the impeller side chamber from the pressure chamber or spiral chamber. This fragmented solid matter is then kept in movement by way of the means for producing turbulences in the impeller side chamber, so that an accumulation or agglomeration of this solid matter in parts of the impeller side chamber is prevented and the solid matter with fluid can be delivered through the grooves in the sealing surface again to the suction side of the impeller.

The annular gap preferably forms the lower annular gap of the impeller which seals off the pressure chamber of the impeller to the bottom, i.e., to the suction port and the impeller side chamber. This annular gap can be designed or function as a labyrinth seal or part of a labyrinth seal.

The annular gap is preferably formed between an outer annular surface on the periphery or outer periphery of the impeller and a radially oppositely lying inner peripheral surface of a pump housing or spiral housing surrounding the impeller.

The means for fragmenting solid manner is further preferably formed by at least one radially inwardly directed recess in the annular surface. For example, the outer annular surface on the impeller comprises at least one recess which is directed radially inwards and is open to the outer periphery. For example, a deepening is formed in the annular surface. The deepening is preferably shaped such that it has a constant cross section over its axial extension in the direction of the longitudinal axis or rotation axis. The shape of the groove is thereby preferably designed in an essentially cylindrical manner, preferably in the shape of half a circular cylinder, i.e., with a semicircular cross section.

Further preferably, several radially inwardly directed recesses are formed in the annular surface and these recesses are preferably uniformly distributed over the periphery. The recesses thereby are designed in the previously described manner. Thus, for example, four such recesses can be arranged distributed over the periphery in a uniformly distributed manner.

Moreover, a radially outwardly directed recess is preferably formed in the inner peripheral surface of the spiral housing or pump housing, said inner peripheral surface lying opposite the annular surface. For example, a deepening which is open to the inner periphery is formed in this inner peripheral surface. This recess too preferably has a constant crops section over its axial extension parallel to the rotation axis. Thus, the recess is likewise designed in a preferably cylindrical manner, in particular in the form of a half circular cylinder with a semicircular cross section. Only one such groove is preferably formed in the inner peripheral surface. This groove is thereby preferably situated in a region of the spiral housing, in which the pressure difference between the pressure chamber at the exit side of the impeller and the impeller side chamber is as low as possible. The recess in the inner peripheral surface is therefore preferably situated in the region of that peripheral end of the spiral chamber which is away from the outlet. This is the region, in which the lowest pressure prevails in the spiral chamber and thus the lowest pressure difference between the spiral chamber which surrounds the exit side of the impeller on the outer periphery, and the impeller side chamber. In this manner, one prevents additional contamination being pressed through this groove by a high pressure difference in the impeller side chamber.

Due to the fact that the grooves in the inner peripheral surface and the annular surface lie in oppositely lying surfaces, these grooves brush over one another in the inside of the inner peripheral surface with the rotation of the impeller and a shear effect is produced, which leads to the breaking up of solid matter which enters into the annular gap.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
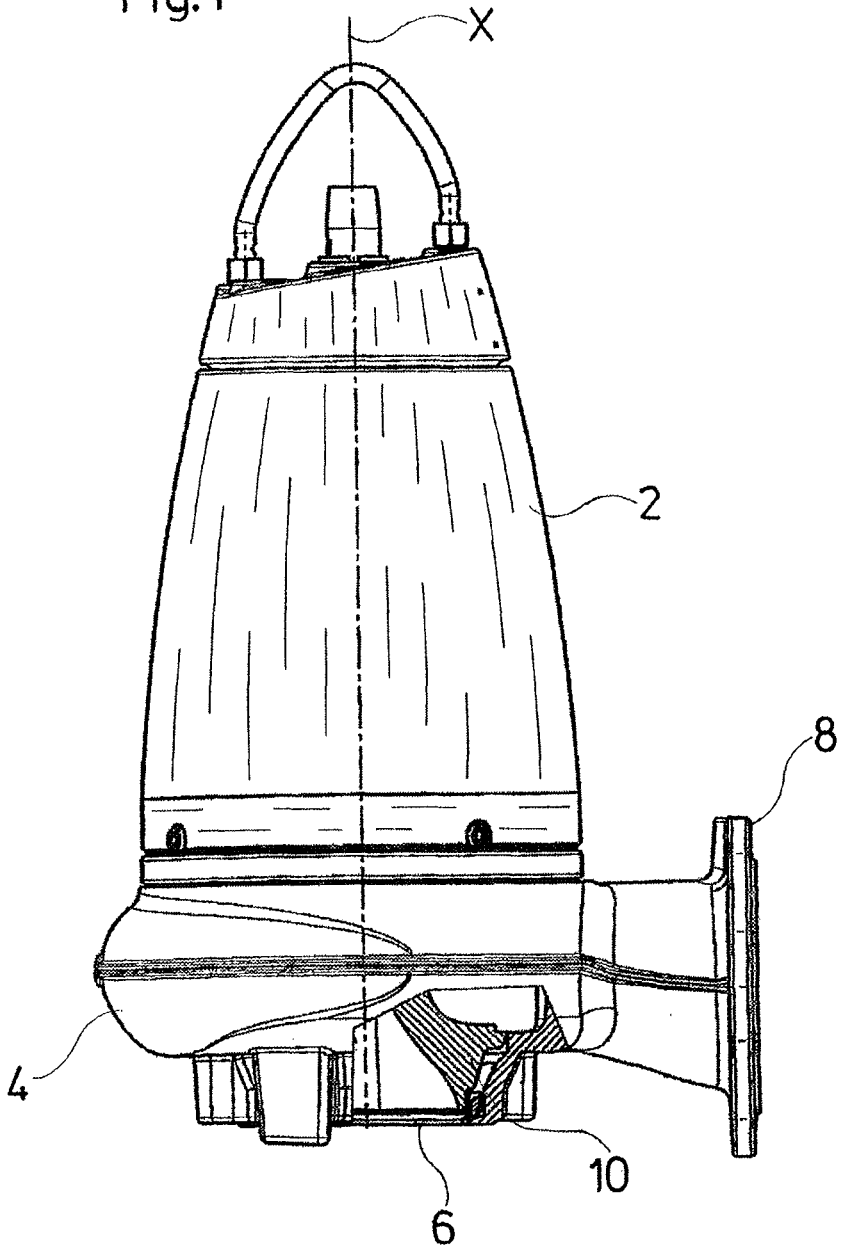
FIG. 1 is a partial cross-sectional elevational view of a waste water pump, in the form of a submersible pump, according to a preferred embodiment of the present invention.
Figure 2:
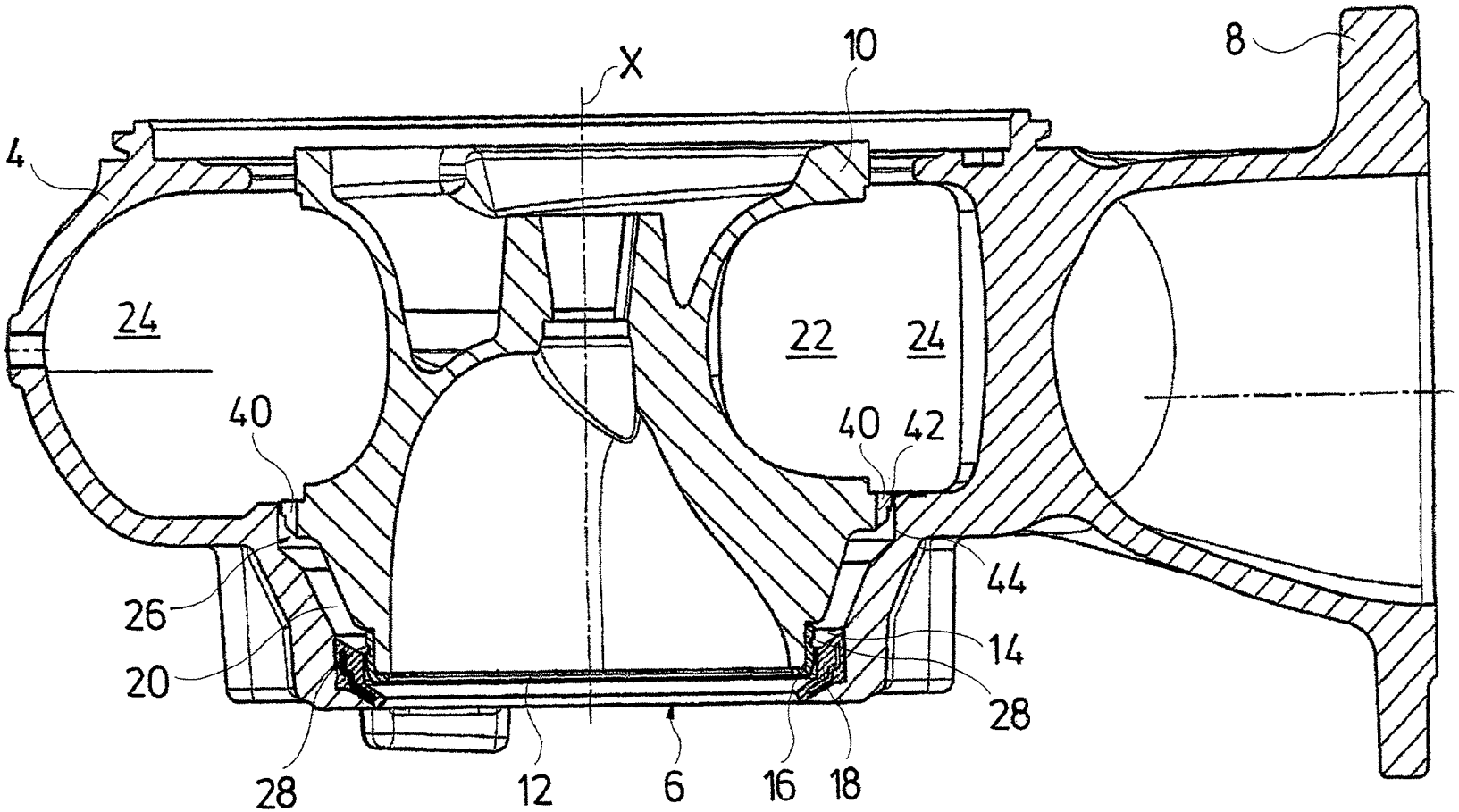
FIG. 2 is a cross-sectional view of a pump housing of the pump of FIG. 1 with an impeller arranged therein.
Figure 3:
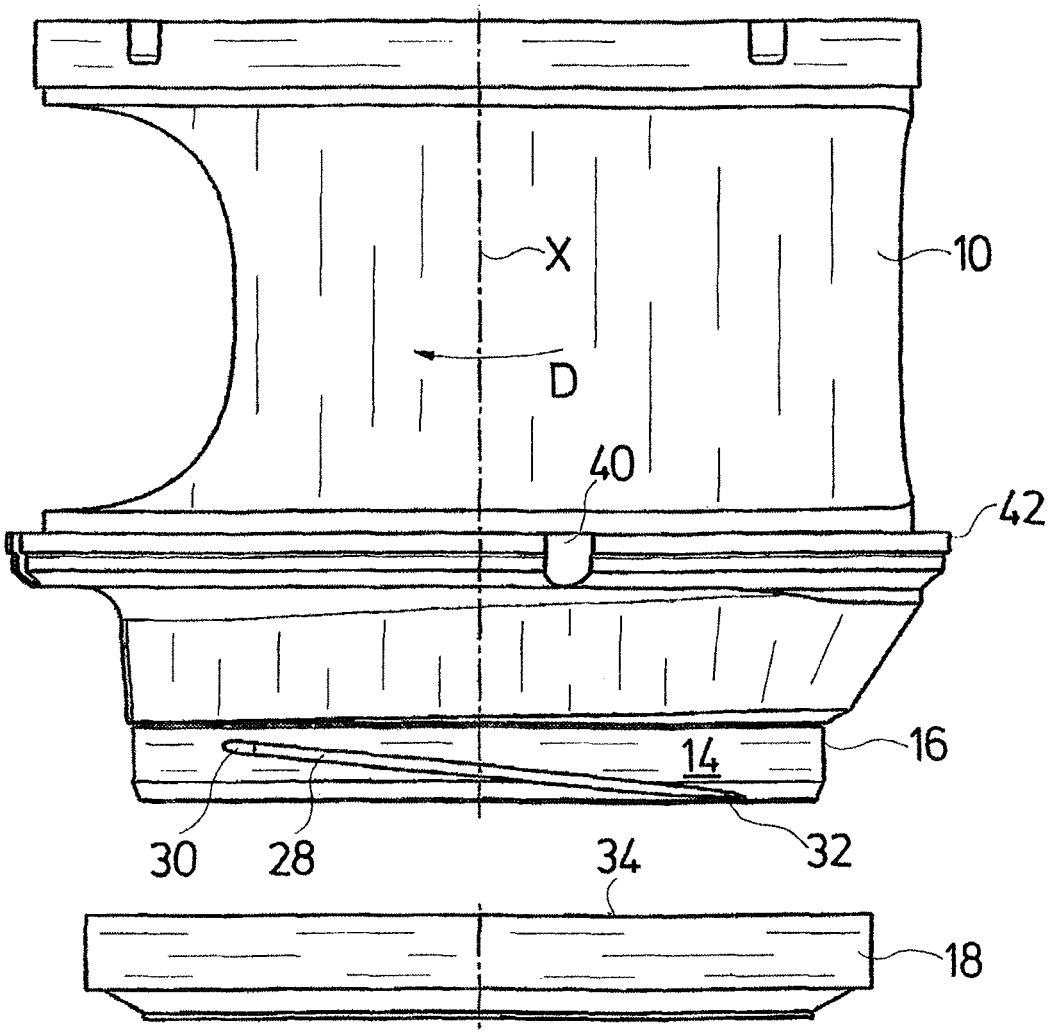
FIG. 3 is a lateral view of the impeller and a seal.
Figure 4:
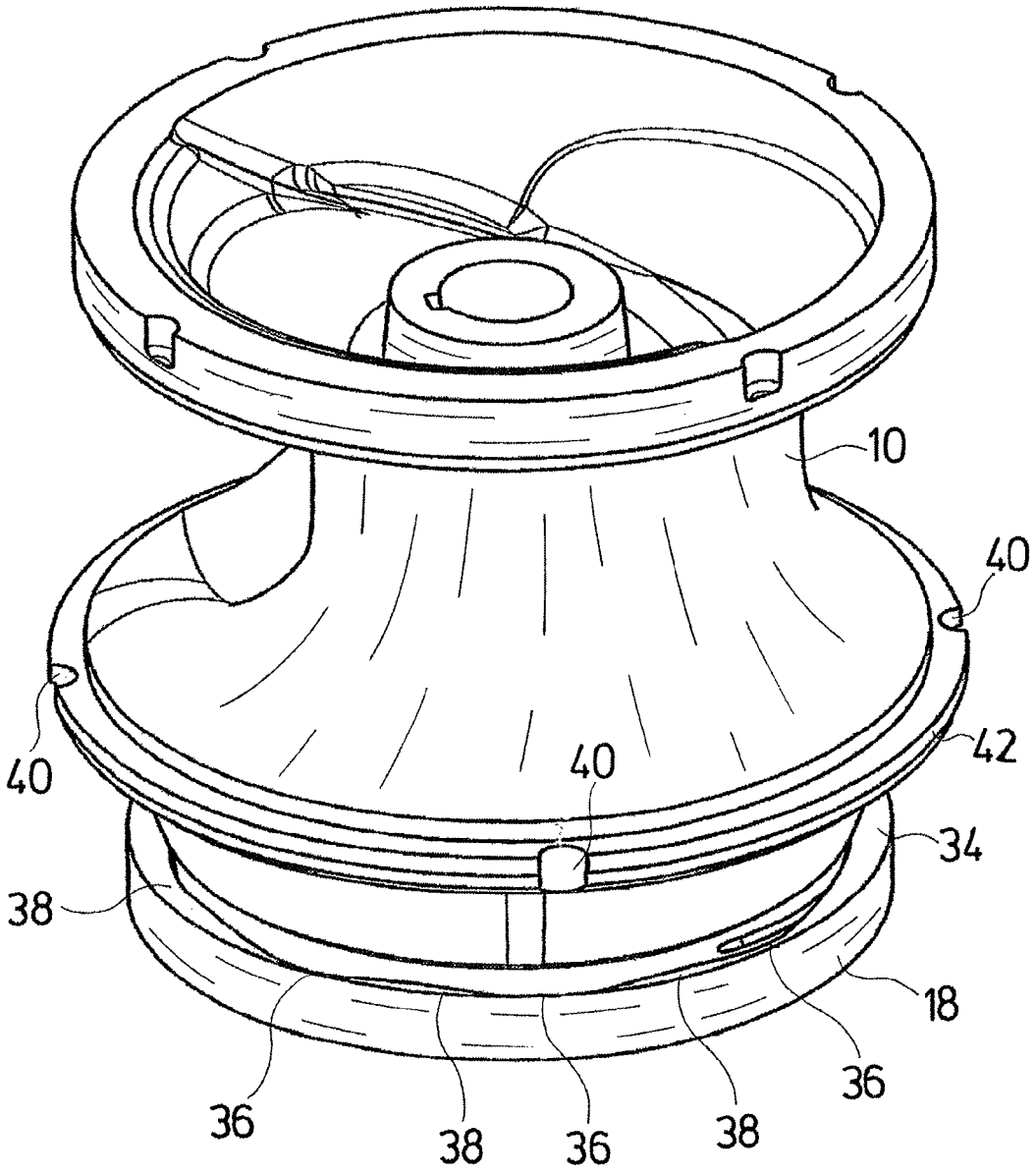
FIG. 4 is a perspective view of the impeller with the seal.
Figure 5:
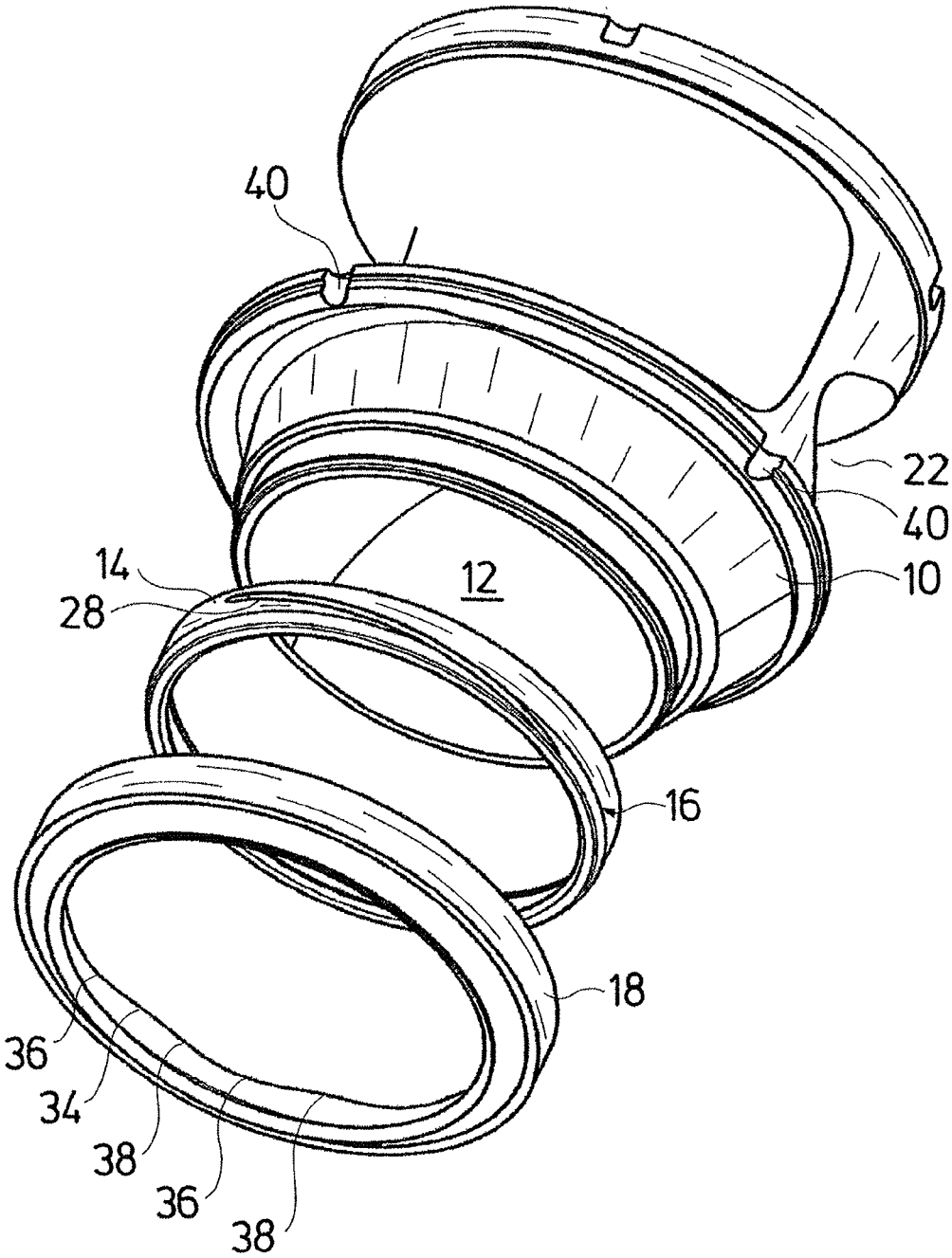
FIG. 5 is an exploded view of the impeller with the seal.
Figure 6:
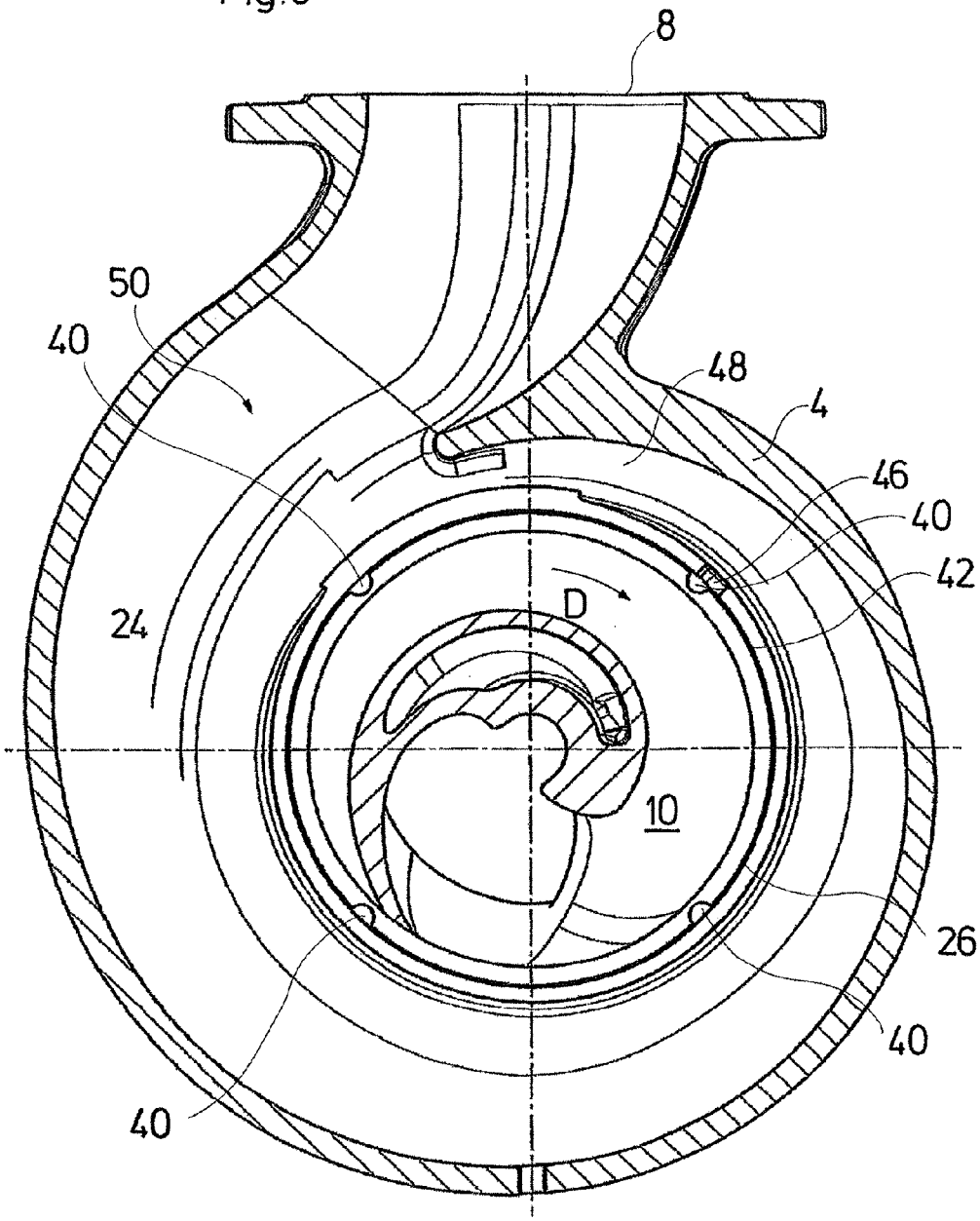
FIG. 6 is a cross sectional view of the pump housing with an inserted impeller.
Figure 7:
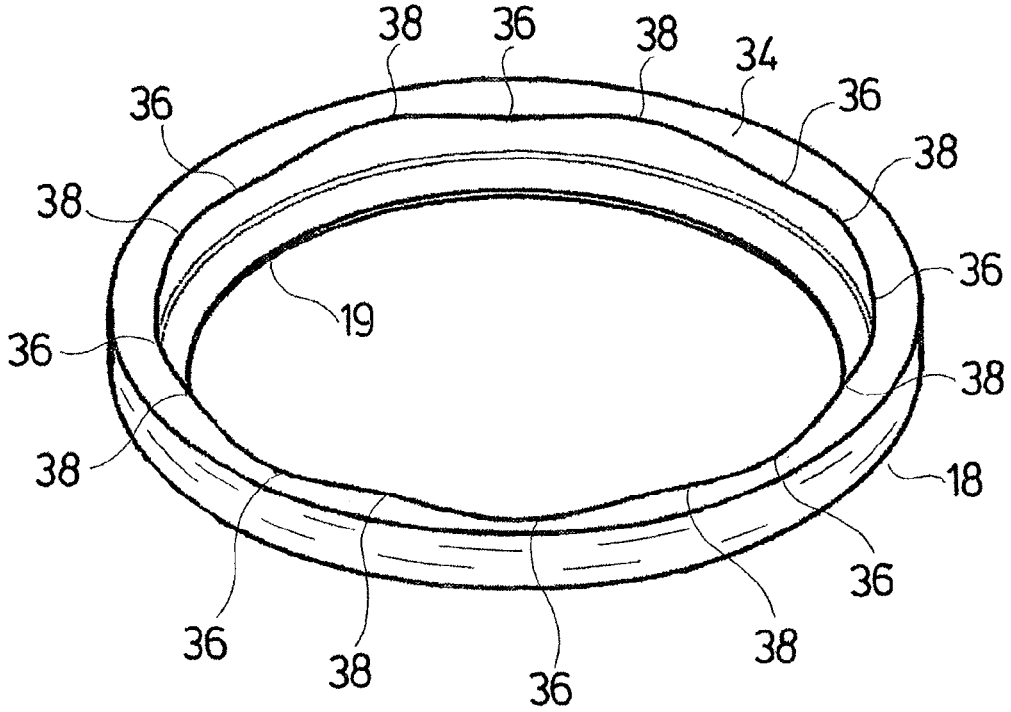
FIG. 7 is a perspective view of the seal.
Figure 8:
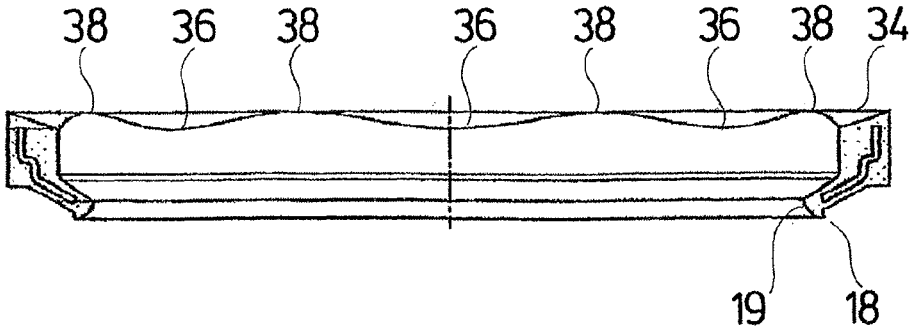
FIG. 8 is a cross-sectional elevation view of the seal.

Certain terminology is used in the following description for convenience only and is not limiting. The words "lower," "bottom" and "front" designate directions in the drawings to which reference is made. The words "inwardly," "outwardly" and "downwardly" refer to directions toward and away from, respectively, the geometric center of the device, and designated parts thereof, in accordance with the present invention. Unless specifically set forth herein, the terms "a," "an" and "the" are not limited to one element, but instead should be read as meaning "at least one." The terminology includes the words noted above, derivatives thereof and words of similar import.

Referring to the drawings in detail, wherein like numerals indicate like elements throughout the several views, the shown waste water pump of a preferred embodiment of the present invention is designed as a submersible pump assembly with an electric drive motor 2 and with a pump housing 4 arranged on the lower end of the drive motor 2. The pump housing 4 on a lower side thereof is provided with a central opening 6 which forms the entry opening or the suction port of the pump assembly. A pressure connection 8, on which an outlet conduit is connected, extends in a lateral direction, radially to a rotation axis X. An impeller 10 which is designed as a single-channel impeller is arranged in the inside of the pump housing 4 designed as spiral housing. The impeller 10 includes a suction port 12 on a lower side thereof. The suction port 12 is surrounded by a sealing surface 14 which extends concentrically to the rotation axis X and which is designed on the outer periphery of a wear ring 16. The wear ring 16 is placed onto the cast impeller 10 at the axial end thereof and can be exchanged when worn.

A seal in the form of a sealing ring 18 is preferably arranged in the pump housing 4 surrounding the opening 6 in a manner lying radially opposite and concentrically surrounding the wear ring 16. The sealing ring 18 sealingly bears with an inner periphery 19 thereof in the form of a sealing lip on the sealing surface 14. The sealing ring 18 is preferably manufactured of an elastomer material and includes a metal core for shape stability. The sealing ring 18 is exchangeable. Via the bearing contact on the sealing surface 14, the sealing ring 18 seals the suction region of the impeller 10 with respect to a connecting impeller side chamber 20. The impeller side chamber 20 surrounds the axial end of the impeller 10 which is adjacent to the suction port 12 and forms an intermediate pressure chamber. The impeller side chamber 20 surrounds the axial end of the impeller 10 which is adjacent the suction port 12 and forms an intermediate pressure chamber. The impeller side chamber 20 thus in the axial direction X lies between the suction port 12 and the exit region 22 of the impeller 10. The exit region 22 of the impeller 10 is peripherally surrounded by a pressure chamber or spiral chamber 24 which is connected to the pressure connection 8. The spiral chamber 24 is separated from the impeller side chamber 20 by an annular gap 26.

With the waste water pump shown here, there is the problem that solid matter or contamination can enter from the spiral chamber 24 through the annular gap 26 into the impeller side chamber 20. According to a preferred embodiment of the present invention, measures are taken in order to permit contamination to leave the impeller side chamber 20 again and thus to prevent an accumulation of solid manner or contamination in the impeller side chamber 20 which could lead to a blockage of the impeller 10. Thus, on the one hand, the wear ring 16 on the sealing surface 14 is provided with two diametrically oppositely lying grooves 28. The grooves 28 extend inclined in the peripheral direction over the sealing surfaces 14. Thereby, the grooves 28 are inclined such that they extend inclined to a cross-sectional plane at right angles to the rotation axis X. Moreover, a first longitudinal end 30 is distanced to the opposite second longitudinal end 32 of the groove 28 in the axial direction X by an amount which is larger than the axial bearing-contact region between the inner periphery of the seal 18 and the sealing surface 14. Thereby, the groove 28 is open to the outer periphery, i.e. to the seal 18. In this manner, the first longitudinal end 30 of the groove 28 is open to the impeller side chamber 20 while the second longitudinal end 32 is open to the suction side, i.e., to the opening 6 of the housing 4. The groove 28 thus creates a connection between the suction side and the impeller side chamber 20. The inclination of the groove 28 is selected such that the first longitudinal end 30 is the front end of the groove 28, in a rotation direction D. On rotation of the impeller 10, fluid with solid matter is moved out of the impeller side chamber 20 through the grooves 28 into the suction region of the opening 6 of the pump housing 4, so that solid matter and contamination is led out of the impeller side chamber 20. This is effected on the one hand due to the inclination of the groove 28 in the mentioned direction and the rotation of the impeller 10, and on the other hand by the pressure difference between the impeller side chamber 20 and the suction region of the impeller 10. The pressure in the impeller side chamber 20 is greater than the suction-side pressure of the impeller 10 and less than the exit-side pressure of the impeller 10.

A second measure which of a preferred embodiment of the present invention is the arrangement of means for producing turbulences in the inside of the impeller side chamber 20. The means for producing turbulences in this example is a wave-shaped axial surface 34 of the sealing ring 18. The axial surface 34 of the sealing ring 18 delimits the impeller side chamber 20 at its lower end. The surface 34 is provided with alternating wave troughs 36 and wave peaks 38. The wave troughs 36 and the wave peaks 38 are uniformly distributed over the periphery of the sealing ring 18. Moreover, the wave troughs 36 are designed such that departing from the outer periphery of the sealing ring 18, they extend obliquely to the rotation axis X. For example, the wave troughs 36 and wave peaks 38 have their maximal height on the inner periphery of the axial surface 34. For example, the axial distance between the wave troughs 36 and wave peaks 38 is maximal at the inner periphery of the surface 34. There is no wave shape on the outer periphery. For example, the wave troughs 36 departing from the outer periphery of the surface 34 extend downwards to the inner periphery. The wave peaks 38 lie in a plane with the outer periphery of the surface 34.

The wave shape of the surface 34 with a rotation of the impeller 10 which leads to a peripheral movement of the fluid in the impeller side chamber 20, leads to turbulences in the impeller side chamber 20. The effect of these is that contamination and solid matter does not agglomerate, but is distributed individually with fluid in the inside of the impeller side chamber 20. Such solid matter and contamination can be led away individually through the grooves 28 without settling in the impeller side chamber 20.

A third measure of a preferred embodiment of the present invention is the arrangement of means for fragmenting solid matter in the region of the annular gap 26 between the spiral chamber 24 and the impeller side chamber 20. The means for fragmenting solid matter is formed by four recesses 40 which are formed in an annular surface 42 which delimits the annular gap 26 on its inner periphery. The annular surface 42 on the outer periphery of the impeller 10 lies radially opposite an inner peripheral surface 44 of the pump housing 4, so that the inner peripheral surface 44 delimits the annular gap 26 on its outer periphery. The recesses 40 are directed radially inwards and have a semicircular cross section. Thereby, the recesses 40 have a constant cross section over their axial length and parallel to the rotation axis X, so that they have the shape of a half a circular cylinder. Moreover, a further recess 46 is arranged on the inner peripheral surface 44. The recess 46 is directed radially outwards and is open to the inner periphery of the inner peripheral surface 44. The one recess 46 is situated such that the recesses 40 brush over the recess 46 on rotation of the impeller 10. Thus, a shear effect between the recesses 40 and the recess 46 is achieved, so that contamination for example solid matter such as fibres, are reduced in size between the recesses 40 and the recess 46 by way of the shear effect on passage through the annular gap 26, so that the solid matter enters into the impeller side chamber 20 with a reduced size and can then later exit the impeller side chamber 20 through the grooves 28.

The one recess 46 on the inner peripheral surface 44 is arranged in the region of the spiral chamber 20, at which the lower pressure difference to the impeller side chamber 20 prevails. This is in the region of the peripheral end 48 of the pressure chamber or spiral chamber 24, the peripheral end being away from the outlet 50 with the pressure connection 8 in the peripheral direction. For example, the recess 46 in the rotation direction D of the impeller 10 is distanced to the outlet 50 in this example by an angle of about 45°.

An optimal discharge of solid matter entering into the impeller side chamber 20, to the suction region of the impeller 10 can be ensured and an undesired blockage of the impeller 10 by way of solid matter in the impeller side chamber 20 can be largely prevented, by way of the fragmentation of solid matter with the help of the recesses 40 and 46 in the annular gap 26 and the production of turbulences in the impeller side chamber by way of the waved surface 34 of the sealing ring 18 as well as the arrangement of the grooves 28 on the sealing surface 14.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A waste water pump comprising:

an impeller (10) including a suction port (12), a sealing surface (14) annularly surrounding the suction port and sealingly bearing on a stationary seal (18) in an axial region of contact between the sealing surface (14) and the stationary seal (18) forming an axial bearing-contact region of the stationary seal (18) on the sealing surface (14), at least one groove (28) being formed in the sealing surface (14) and extending axially beyond the axial bearing-contact region of the stationary seal (18) on the sealing surface (14), the groove (28) including a first end (30) in connection with an impeller side chamber (20) and an opposite second end (32) in connection with a suction side of the impeller (10), and a surface (34) being arranged in the impeller side chamber (20) adjacent the stationary seal (18) for producing turbulences.

2. The waste water pump according to claim 1, wherein the surface (34) for producing turbulences is formed on the stationary seal (18).

3. The waste water pump according to claim 2, wherein the stationary seal (18) faces the impeller side chamber (20).

4. The waste water pump according to claim 3, wherein the stationary seal (18) is designed in an annular manner and the surface (34) for producing turbulences is located on an axial end-side of the stationary seal (18).

5. The waste water pump according to claim 1, wherein the sealing surface (14) is formed on an outer peripheral surface of the impeller (10) and is surrounded by the stationary seal (18).

6. The waste water pump according to claim 1, wherein the sealing surface (14) and the stationary seal (18) bear radially on one another.

7. The waste water pump according to claim 1, wherein the groove (28) extends in a rotation direction (D) of the impeller (10), the groove (28) being inclined in a manner such that the first end (30) which is at a front in the rotation direction (D) faces the impeller side chamber (20).

8. The waste water pump according to claim 1, wherein the groove (28) only extends in a peripheral part-region of the sealing surface (14).

9. The waste water pump according to claim 1, wherein one or more recesses (40, 46) are formed in an annular gap (26) which connect the impeller side chamber (20) to a spiral chamber (24) surrounding the impeller (10), the one or more recesses (40, 46) fragmenting solid matter.

10. The waste water pump according to claim 9, wherein the annular gap (26) is formed between an outer annular surface (42) on a periphery of the impeller (10) and a radially oppositely lying inner peripheral surface (44) of a spiral housing (4) surrounding the impeller (10).

11. The waste water pump according to claim 10, wherein at least one radially inwardly directed recess (40) of the one or more recesses (40, 46) is formed in the outer annular surface (42).

12. The waste water pump according to claim 11, wherein several radially inwardly directed recesses (40) of the one or more recesses (40, 46) are formed in the annular surface (42) and are uniformly distributed over the periphery.

13. The waste water pump according to claim 12, wherein a radially outwardly directed recess (46) of the one or more recesses (40, 46) is formed in the radially oppositely lying inner peripheral surface (44) which lies opposite the annular surface (42).

14. The waste water pump according to claim 13, wherein the recess (46) in the inner peripheral surface (44) of the spiral housing (4) is situated in the region of a peripheral end of the spiral chamber (24) which is away from an outlet (50).

15. The waste water pump according to claim 10, wherein one or more recesses (40, 46) each has a semicircular cross section.

* * * * *